US010316531B2

(12) United States Patent
McGowan et al.

(10) Patent No.: US 10,316,531 B2
(45) Date of Patent: Jun. 11, 2019

(54) TRIM KIT

(71) Applicant: Draper, Inc., Spiceland, IN (US)

(72) Inventors: Darvin L. McGowan, Knightstown, IN (US); Neal A. Turner, Greenfield, IN (US); David M. Jones, Pearland, TX (US)

(73) Assignee: Draper, Inc., Spiceland, IN (US)

( * ) Notice: Subject to any disclaimer, the term of this patent is extended or adjusted under 35 U.S.C. 154(b) by 0 days.

(21) Appl. No.: 15/209,652

(22) Filed: Jul. 13, 2016

(65) Prior Publication Data

US 2018/0016800 A1 Jan. 18, 2018

(51) Int. Cl.
*E06B 3/00* (2006.01)
*E04H 3/14* (2006.01)
*E04F 19/04* (2006.01)

(52) U.S. Cl.
CPC ..... *E04H 3/14* (2013.01); *E04F 19/0495* (2013.01)

(58) Field of Classification Search
CPC ..... E06B 1/56; E04F 19/026; E04F 13/075; E04F 19/08; E04F 11/06
USPC ..... 52/717.01, 716.1, 718.04, 211, 287.1, 52/220.8, 716.8
See application file for complete search history.

(56) References Cited

U.S. PATENT DOCUMENTS 1,735,501 A * 11/1929 Hammill ..... E06B 9/522 160/374
3,451,153 A * 6/1969 Dohanyos ..... A47G 1/08 40/741
3,480,210 A 11/1969 Perrinjaquet
3,888,013 A 6/1975 Benoit
4,228,592 A 10/1980 Badger
4,259,785 A 4/1981 Wortham
4,345,381 A 8/1982 Brislin
4,462,186 A * 7/1984 Fuller ..... E06B 3/9641 160/376
4,589,211 A 5/1986 Policka
4,608,800 A * 9/1986 Fredette ..... E04F 13/0803 52/211

(Continued)

FOREIGN PATENT DOCUMENTS

CA 2593856 A1 1/2009
DE 3523738 A1 * 1/1987 ..... E04F 19/08

(Continued)

OTHER PUBLICATIONS

*Hot Wheels Zip Rippers Rip-Up Raceway Track Set*, ToysRUs, http://www.toysrus.com/buy/race-tracks-play-sets/hot-wheels-zip-rippers-rip-up-raceway-track-set-edf30-71419366, © 2016 Geoffrey, LLC, accessed Jun. 21, 2016, 4 pages.

(Continued)

*Primary Examiner* — Beth A Stephan
(74) *Attorney, Agent, or Firm* — Faegre Baker Daniels LLP

(57) ABSTRACT

A modular trim kit including a number of modular trim pieces and a number of connectors which can be utilized to secure a first trim module to a second trim module to allow the modules to be assembled in a shape matching a cutout in a wall pad. In certain exemplifications of the present disclosure, a single trim module may be utilized to trim the cutout. In configurations in which the cutout is formed with angled corners to define a polygonal cutout, the kit may include corner trim modules sized and shaped to accommodate trimming at the vertices of the polygonal cutout.

10 Claims, 10 Drawing Sheets

(56) References Cited

U.S. PATENT DOCUMENTS

D286,434 S 10/1986 Schmidt
4,702,051 A * 10/1987 Miller ..... E06B 3/28 403/402
4,738,069 A * 4/1988 Williams ..... B60R 13/04 403/402
D369,091 S 4/1996 Cooper
5,617,660 A 4/1997 Pollack
5,647,172 A 7/1997 Rokicki
5,704,410 A * 1/1998 Kuo ..... A47H 2/00 160/38
5,711,120 A * 1/1998 Karpen ..... E06B 5/165 52/204.54
5,860,219 A 1/1999 Wilkinson
5,863,030 A 1/1999 Kotler et al.
5,921,056 A * 7/1999 Weiss ..... E06B 1/62 52/212
D418,738 S 1/2000 Lutrell-Welti
6,089,778 A 7/2000 Hirano et al.
6,094,796 A * 8/2000 Biro ..... A47H 2/00 29/412
6,226,882 B1 5/2001 Barr
6,332,657 B1 * 12/2001 Fischer ..... A47B 47/0008 312/111
6,377,320 B1 * 4/2002 Ananian ..... G06F 1/1609 312/7.2
D457,052 S 5/2002 Snyder
6,601,774 B1 8/2003 Kasimoff
6,604,334 B2 * 8/2003 Rochman ..... E06B 1/34 52/211
6,647,652 B1 11/2003 Seiber et al.
D485,582 S 1/2004 Valiulis
D489,828 S 5/2004 Barnett
6,817,144 B1 * 11/2004 Tavivian ..... A47K 3/30 4/607
6,962,262 B2 11/2005 Toma
7,146,774 B2 * 12/2006 Fredette ..... E04F 13/0864 52/656.6
D585,267 S 1/2009 Di Vinadio
7,775,003 B2 * 8/2010 Sabac ..... G03B 17/26 52/204.53
7,819,778 B1 10/2010 Sudeith et al.
7,877,825 B1 * 2/2011 Marshall ..... A47K 3/30 4/612
D656,628 S 3/2012 DiGennaro
D661,524 S 6/2012 Watts
D666,033 S 8/2012 Sauer
D680,887 S 4/2013 Dressel et al.
D683,797 S 6/2013 Sjödin
D685,856 S 7/2013 Hawkins
8,561,357 B2 * 10/2013 Teodorovich ..... E06B 1/62 52/204.1
8,661,751 B1 * 3/2014 Lawrie ..... E04F 19/064 52/272
D718,880 S 12/2014 Farman
D718,881 S 12/2014 Farman
D718,882 S 12/2014 Farman
8,898,985 B2 12/2014 Lehane, Jr.
9,021,753 B2 * 5/2015 Michaud ..... E06B 1/68 277/640
D733,927 S 7/2015 Van Camp
D736,105 S 8/2015 Hoyt
9,140,017 B1 9/2015 Oliver
D754,498 S 4/2016 Robinson
D760,403 S 6/2016 Bilge
2001/0034984 A1 * 11/2001 Murphy ..... E06B 1/62 52/204.5
2002/0104276 A1 * 8/2002 Lucas, Jr. ..... E06B 7/16 52/204.53
2002/0104277 A1 * 8/2002 Carlson ..... E06B 1/6046 52/208
2002/0166299 A1 * 11/2002 Day ..... E06B 3/9624 52/211
2003/0037495 A1 * 2/2003 Shaw ..... E04F 19/022 52/287.1
2004/0083617 A1 5/2004 Bielen
2004/0250475 A1 * 12/2004 Seaman ..... E06B 3/92 49/501
2005/0011079 A1 1/2005 Sikora, Jr. et al.
2006/0225378 A1 * 10/2006 Hu ..... B65D 7/14 52/648.1
2009/0193729 A1 8/2009 Kustermann
2009/0277028 A1 11/2009 Dunn
2009/0313841 A1 12/2009 Calleros
2012/0096724 A1 4/2012 Eyermann et al.
2012/0131870 A1 * 5/2012 deMaere ..... E04B 2/8635 52/309.4
2013/0104491 A1 * 5/2013 David ..... E04F 19/08 52/656.4
2016/0069093 A1 3/2016 Hawk

FOREIGN PATENT DOCUMENTS

DE 19527547 A1 * 2/1996 ..... E04F 19/08
EP 1633939 B1 8/2009
GB 2413519 A 11/2005
GB 2441139 A 2/2008
GB 2441749 A 3/2008
GB 2460836 A 12/2009
GB 2519759 A 5/2016

OTHER PUBLICATIONS

*Hot Wheels Instructions*, © 2006 Mattel, Inc., 2 pages.
*Wall Pad Cut-Out Trim Kits*, Draper, Inc.—Sweets, http://sweets.construction.com/Manufacturer-Draper--Inc--NST1446/products/Wall-Pad-Cut-Out-Trim-Kits-NST62732-P, accessed May 26, 2016, © 2016 Dodge Data & Analytics, 4 pages.
*Hadar Wooden Trim for Wall Mats*, HadarAthletic.com, http://hadarathletic.com/catalog/viewcatalog/wfview.asp, accessed May 26, 2016, 2 pages.
*7" x 7" Outlet Cutout With Insert for Bison Wall Padding*, Bison Inc., https://www.bisoinc.com/product/sport-pride-and-customization/7x-7-outlet-cutout-with-insert-for-bison-wall-padding, accessed May 26, 2016, © 2016 Bison Inc., 5 pages.
*Wall Padding Duplex Outlet Cutout Trim*, © 2016 Bison Inc., https://www.bisoninc.com/product/sport-pride-and-customization/wall-padding-duplex-outlet-cutout-trim, 5 pages.
*Cut Perfect Holes for Electrical Boxes, Lights, Speakers, and More in Seconds Without Mistakes or Repairs*, CUTzOUT Installation Templates, https://cutzout.com, Praxis Products, LLC 2007-2015, 8 pages.
*Rubber Outlet / Receptacle Cover Insert Single Outlet Insert*, Resilite Sports Products, Inc., http://www.resilite.com/Products/Rubber-Outlet-Receptacle-Cover-Insert_KSOC.aspx, Nov. 4, 2014, © 2014 Resilite Sports Products, Inc., 2 pages.
*Model WP20F Instruction Manual*, Bison Inc., https://www.bisoninc.com/wordpress/wp-content/uploads/WP20F-InstructionManual, at least available as of May 27, 2016.
*Installing Electrical Outlet (and/or Electrical Switch) Trim*, Faux Panels, http://www.fauxpanels.com;install-electrical-outlets.php, ©Faux Panels, at least available as of Jun. 2, 2016, 6 pages.
*Molded Wall Pad Cut-Out Kit Single*, http://store.adplemco.com/molded-wall-pad-cut-out-kit-single.html, ADP Lemco, Inc., at least available as of Jun. 2, 2016, 1 page.

* cited by examiner

TRIM KIT

TECHNICAL FIELD

The present disclosure relates to a trim kit for trimming a cutout in a panel, and more particularly, to a modular trim kit adaptable to trim a cutout in a padded wall panel.

BACKGROUND

Padded wall panels, which are sometimes simply referred to as wall pads, are routinely utilized to cushion hard surfaces which may be encountered by people. Wall pads can be placed over the solid wood and/or concrete walls of a sporting venue. For example, wall pads can be placed over outfield walls in baseball stadiums and over the walls of a gymnasium, e.g., adjacent a basketball goal.

Wall pads are typically constructed of three materials:

1) A backing, which can be made of any rigid material (e.g., oriented strand board (OSB) or other types of waferboard);
2) A thick layer of shock absorbing foam (e.g, polyurethane foam, bonded foam, polychloroprene foam, etc.) padding covering the backing, and
3) A covering (e.g., a vinyl cover) positioned over the foam and secured to the backing.

In certain circumstances, it is desirable to place a wall pad over a wall including a functional aspect, such as e.g., an electrical outlet, a water fountain or a window opening. In such circumstances, it is also desirable to continue to allow access to the functional aspect after the wall pad is operatively positioned over the wall. Because the size, shape and location of the functional aspect cannot always be predetermined, prefabricated wall panel openings accommodating these situations cannot easily be manufactured.

SUMMARY

To accommodate access to functional aspects of varying size, shape and location, standard wall pads may be modified to allow for a cutout in the wall pad of appropriate size and shape to allow access to the functional aspect, with the wall pad protecting the wall adjacent to the functional aspect. Simply cutting a standard wall pad to provide a cutout to accommodate access to the functional aspect would leave the wall pad with unfinished edges and potentially allow access to and removal of the protective foam of the wall pad. To obviate these issues, the present disclosure provides a modular trim kit which may be utilized to trim the rough edge of the wall pad formed by creating the cutout.

The modular trim kit of the present disclosure generally includes a number of modular trim pieces and a number of connectors which can be utilized to secure a first trim module to a second trim module to allow the modules to be assembled in a shape matching the cutout in the wall pad. In certain exemplifications of the present disclosure, a single trim module may be utilized to trim the cutout. For example, a single elongate trim module may have its opposite ends joined together to form a ring to trim a ring-shaped cutout. In configurations in which the cutout is formed with angled corners to define a polygonal cutout, the kit may include corner trim modules sized and shaped to accommodate trimming at the vertices of the polygonal cutout.

In an exemplification thereof, the present disclosure provides a modular trim kit for trimming a panel. The modular trim kit of this exemplification including: at least one elongate trim module, the at least one elongate trim module having an elongate trim module longitudinal axis, the at least one elongate trim module having an elongate trim module finished surface and an elongate trim module reception channel sized for receipt of a thickness of the panel, the elongate trim module finished surface positioned opposite the elongate trim module reception channel along the first elongate trim module longitudinal axis, whereby, with a thickness of the panel positioned in the first elongate trim module reception channel, the finished surface is exposed opposite the panel. In this exemplification of the present disclosure, the modular trim kit further includes at least one connector sized and shaped to selectively connect to the at least one elongate trim module, the at least one connector having a connector longitudinal axis, with the connector connected to the at least one elongate trim module, and the thickness of the panel positioned in the at least one elongate trim module reception channel, at least a segment of the at least one connector spanning the width of the at least one connector is obscured from view.

In another exemplification thereof, the present disclosure provides a trim module including a plurality of selectively interconnectable trim modules, at least one of the plurality of interconnectable trim modules comprising a corner trim module. In this exemplification of the present disclosure, the corner trim module includes a first leg, the first leg having a substantially linear first leg longitudinal axis running along a length of the first leg, the first leg having a first leg finished surface and a first leg reception channel, the first leg finished surface positioned opposite the first leg reception channel; and a second leg extending from the first leg, the second leg having a substantially linear second leg longitudinal axis running along a length of the second leg, the second leg having a second leg finished surface and a second leg reception channel, the second leg finished surface positioned opposite the second leg reception channel, the first leg longitudinal axis intersecting the second leg longitudinal axis to form an angle, so that the corner trim module can be positioned over a corner of a panel to trim the corner.

In a further exemplification thereof, the present disclosure provides a protective wall panel including a protective wall panel segment and a modular trim kit for trimming a perimeter defining a cut-out in the protective wall panel segment. In this exemplification of the present disclosure, the protective wall panel segment includes a cut-out sized and shaped to allow access to a functional aspect positioned behind the protective wall panel segment. In this exemplification of the present disclosure, the modular trim kit includes at least one elongate trim module and at least one connector, the at least one elongate trim module covering at least a portion of the perimeter defining the cut-out in the protective wall panel, the at least one elongate trim module including a face flange extending over a face of the protective wall panel segment intersecting the perimeter defining the cut-out, the at least one connector selectively connectable to the at least one elongate trim module.

In yet a further exemplification thereof, the present disclosure provides a method of sizing a protective wall panel including the steps of: removing a portion of the protective wall panel to form a cut-out in the protective wall panel; and trimming the cut-out with a modular trim kit. In this exemplification of the present disclosure, the step of trimming the cut-out with a modular trim kit includes the steps of: selecting at least one of a plurality of interconnecting trim modules, each of the plurality of interconnecting trim modules having a reception channel sized for receipt of a thickness of the wall panel and a finished surface; forming a shape corresponding to a perimeter defining the cut-out in the protective wall panel with the at least one of the plurality of interconnecting trim modules; and position the at least one of the plurality of interconnecting trim modules about the perimeter defining the cut-out, with the thickness of the wall panel occupying the reception channel of the at least one of the plurality of trim modules.

In a still further exemplification thereof, the present disclosure provides a modular trim kit for trimming a panel, the modular trim kit including at least one elongate trim module, the at least one elongate trim module having an elongate trim module longitudinal axis, the at least one elongate trim module having an elongate trim module finished surface and an elongate trim module reception channel sized for receipt of a thickness of the panel, the elongate trim module finished surface positioned opposite the elongate trim module reception channel along the first elongate trim module longitudinal axis, the elongate trim module reception channel including a perimeter surface and a face flange; and at least one connector sized and shaped to selectively connect to the at least one elongate trim module, the at least one connector having a connector longitudinal axis, the at least one elongate trim module having a connector channel formed in the perimeter surface, the connector channel defined by a connector channel wall and sized to frictionally receive the at least one connector.

The above-mentioned and other features of the invention and the manner of obtaining them, will become more apparent and the invention itself will be better understood by reference to the following description of exemplary embodiments of the invention taken in conjunction with the accompanying drawings.

Figure 1:
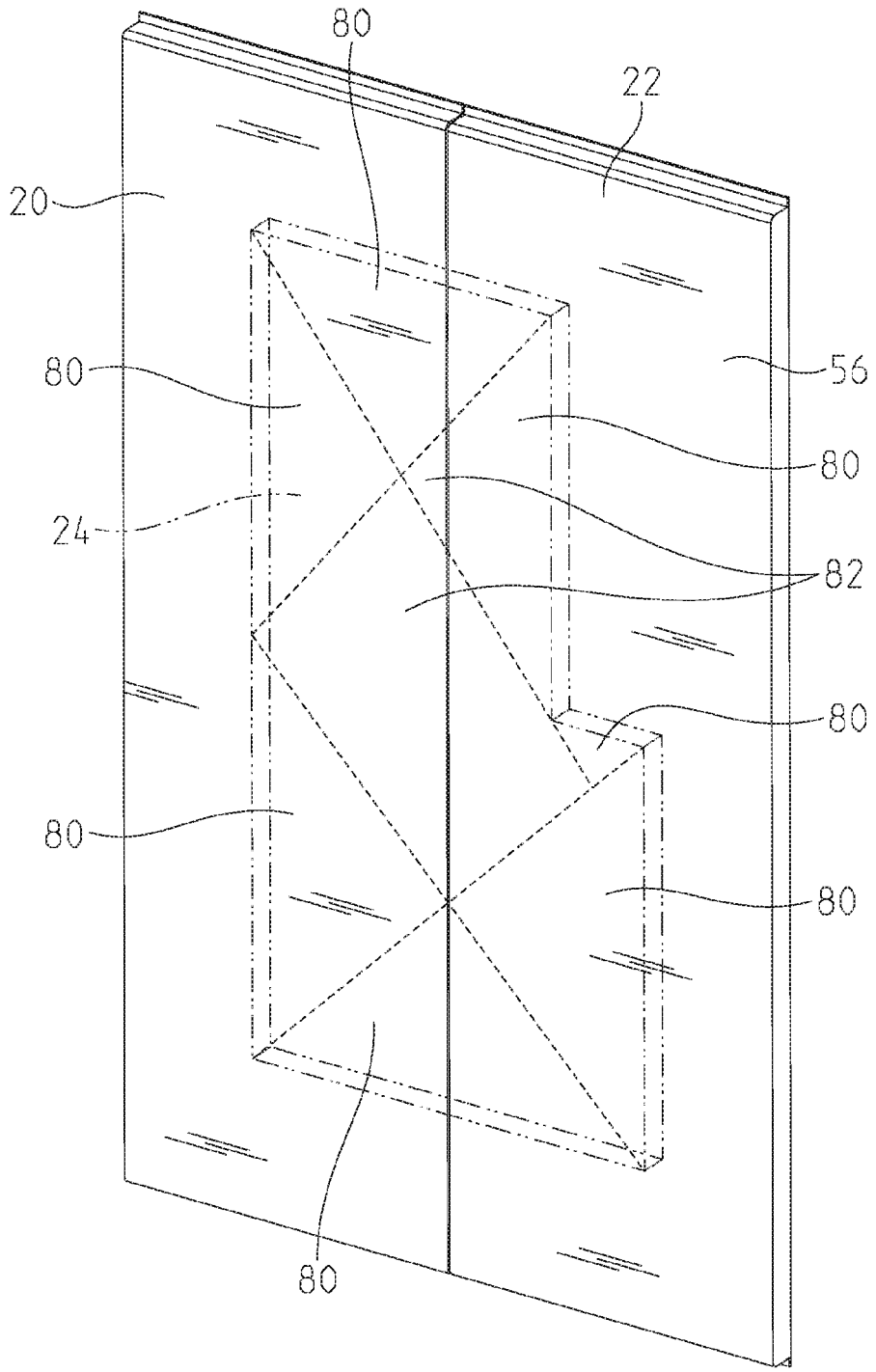
FIG. 1 is a perspective view of a pair of adjacent wall pads showing the outline of a to-be-formed cutout in the two adjacent wall pads.

Additional illustrations of straight trim modules, interior corner trim modules and exterior corner trim modules useable with the teachings of the present disclosure can be found in Design Patent Applications Nos. 29/571,020; 29/571,021 and 29/571,022, each of which is entitled TRIM MODULE, assigned to the assignee of the present application and filed on even date herewith, the entire disclosures of which are hereby expressly incorporated by reference herein.

Corresponding reference characters indicate corresponding parts throughout the several views. Although the drawings represent embodiments of the invention, the drawings are not necessarily to scale and certain features may be exaggerated in order to better illustrate and explain the invention. The exemplifications set out herein illustrate embodiments of the invention, and such exemplifications are not to be construed as limiting the scope of the invention in any manner; and

DETAILED DESCRIPTION

The embodiments disclosed below are not intended to be exhaustive or limit the invention to the precise forms disclosed in the following detailed description. Rather, the embodiments are chosen and described so that others skilled in the art may utilize their teachings.

Figure 2:
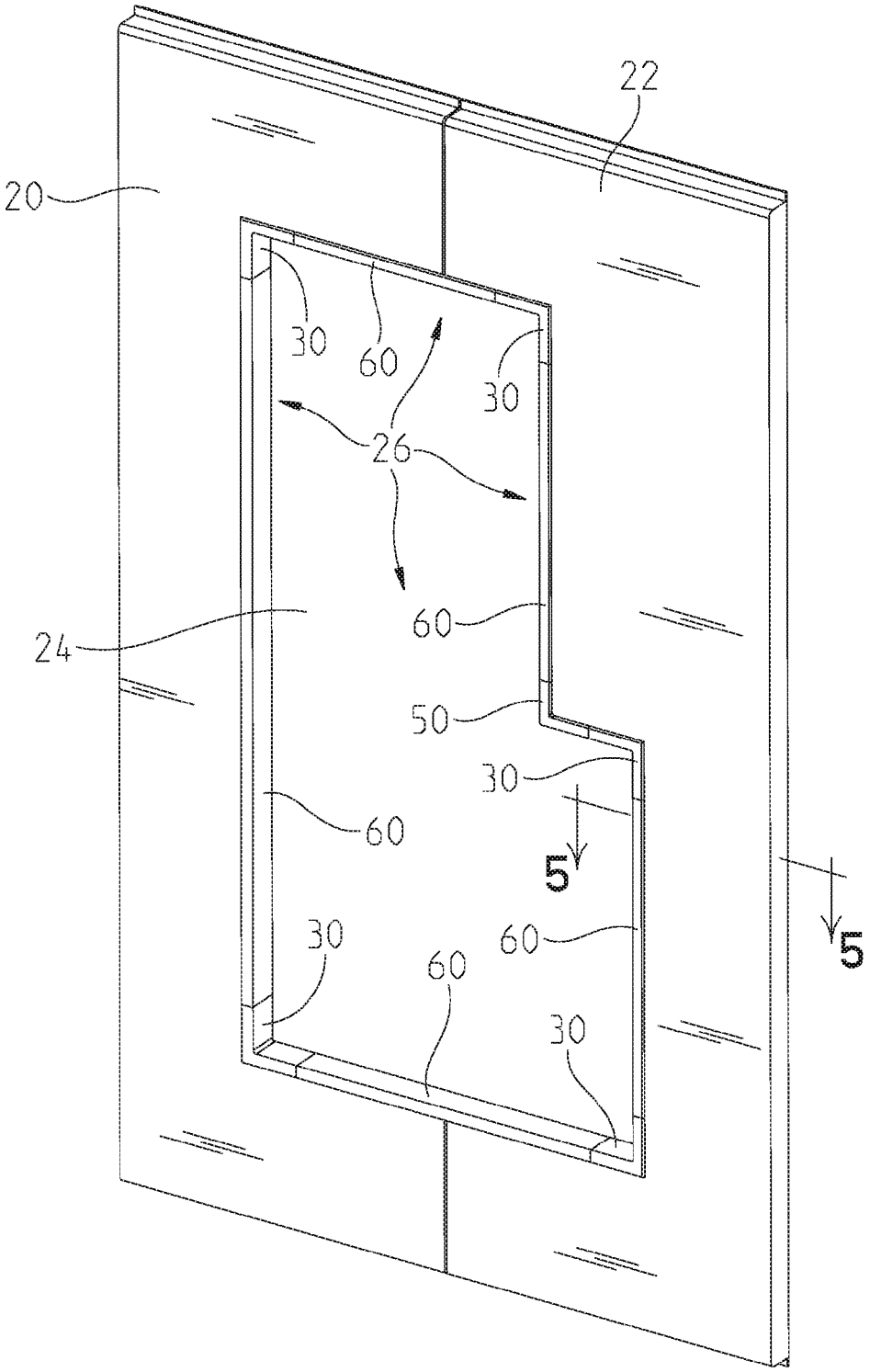
FIG. 2 is a perspective view of the wall pads of FIG. 1 with a cutout formed therein and trimmed by a modular trim kit of the present disclosure.
Figure 5:
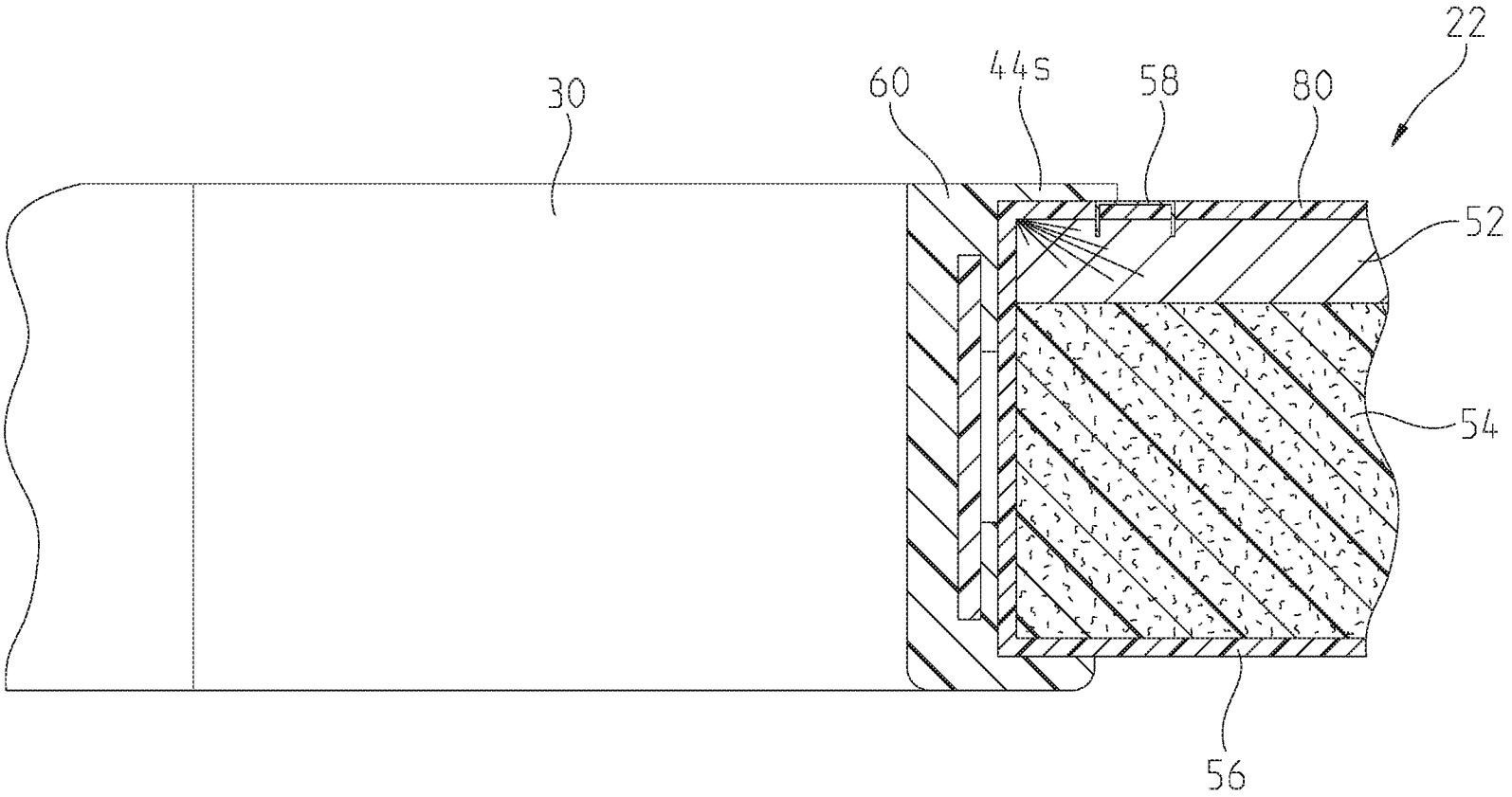
FIG. 5 is a partial sectional view taken along line 5-5 of FIG. 2.

FIG. 1 illustrates first wall panel 20 and adjacent second wall panel 22. First wall panel 20 and adjacent wall panel 22 may be secured together as a unit or may be completely discrete, separate wall panels which will be positioned adjacent to one another over a wall. If secured together as a unit, panels 20, 22 may be considered a single panel. In this instance, cutout 24 is spaced from an outer perimeter of the wall panel. Similarly, if panels 20, 22 are separable, each includes a cutout intersecting an outer perimeter of the panel. FIG. 1 further illustrates the outline for cutout 24. Referring to FIG. 2, cutout 24 is trimmed with trim kit 26 to provide finished edges within cutout 24. FIG. 5 illustrates a sectional view of part of second wall panel 22. As illustrated, the second wall panel 22 is formed of three layers: 1) backing 52; 2) foam layer 54; and 3) covering 56. Backing 52 may be formed of any rigid material, e.g., a 7/16 inch OSB or other type of waferboard. Foam layer 54 may be a 2 inch layer of shock absorbing foam such as polyurethane foam, bonded foam, polychlorprene foam, etc. Covering 56 may be a vinyl covering. First wall panel 20 shares the same construction as second wall panel 22.

Figure 4:
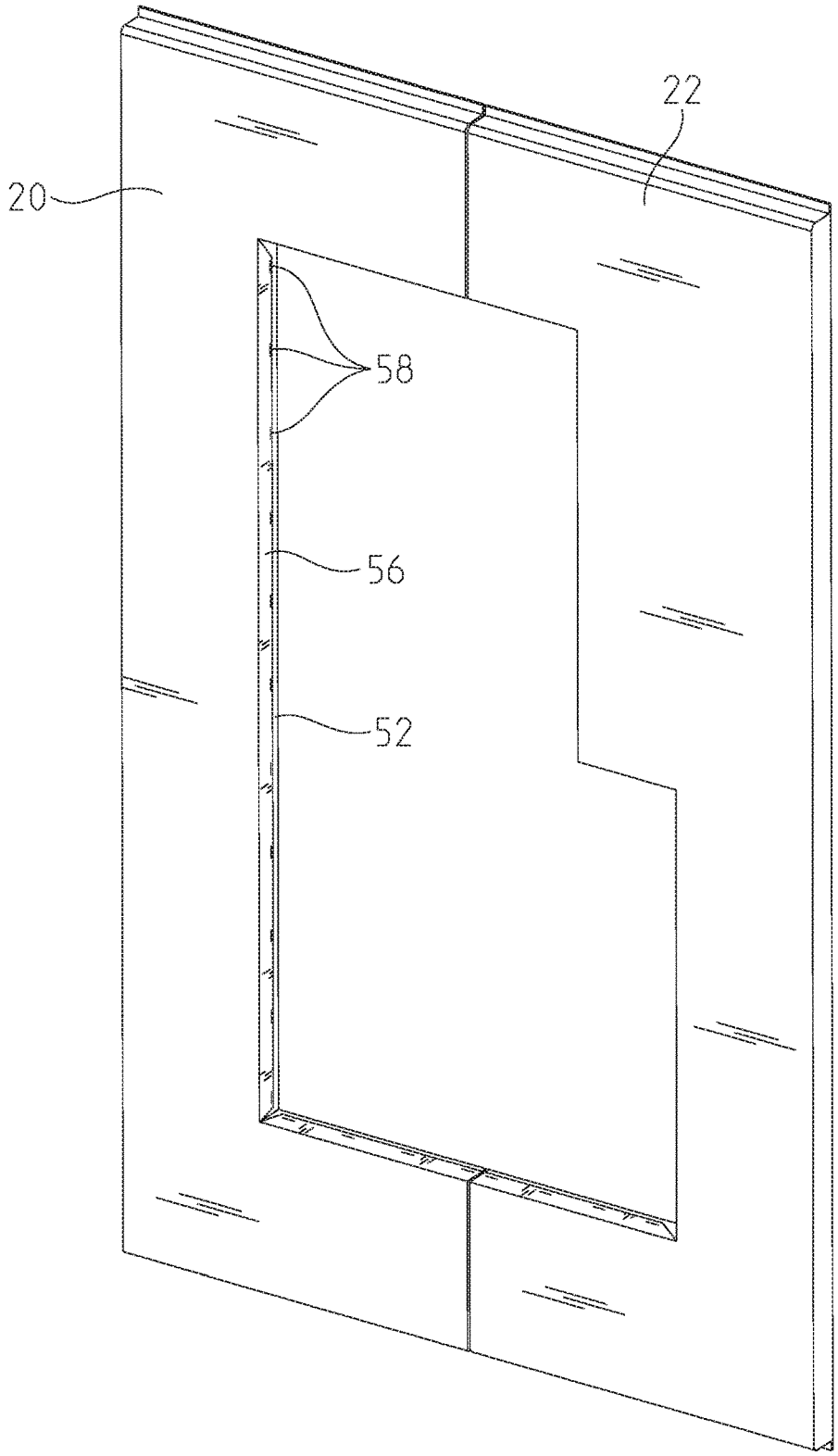
FIG. 4 is a perspective view of the wall pads shown in FIG. 1, after the cutout has been made, but before the trim kit is secured in place to trim the cutout.
Figure 11:
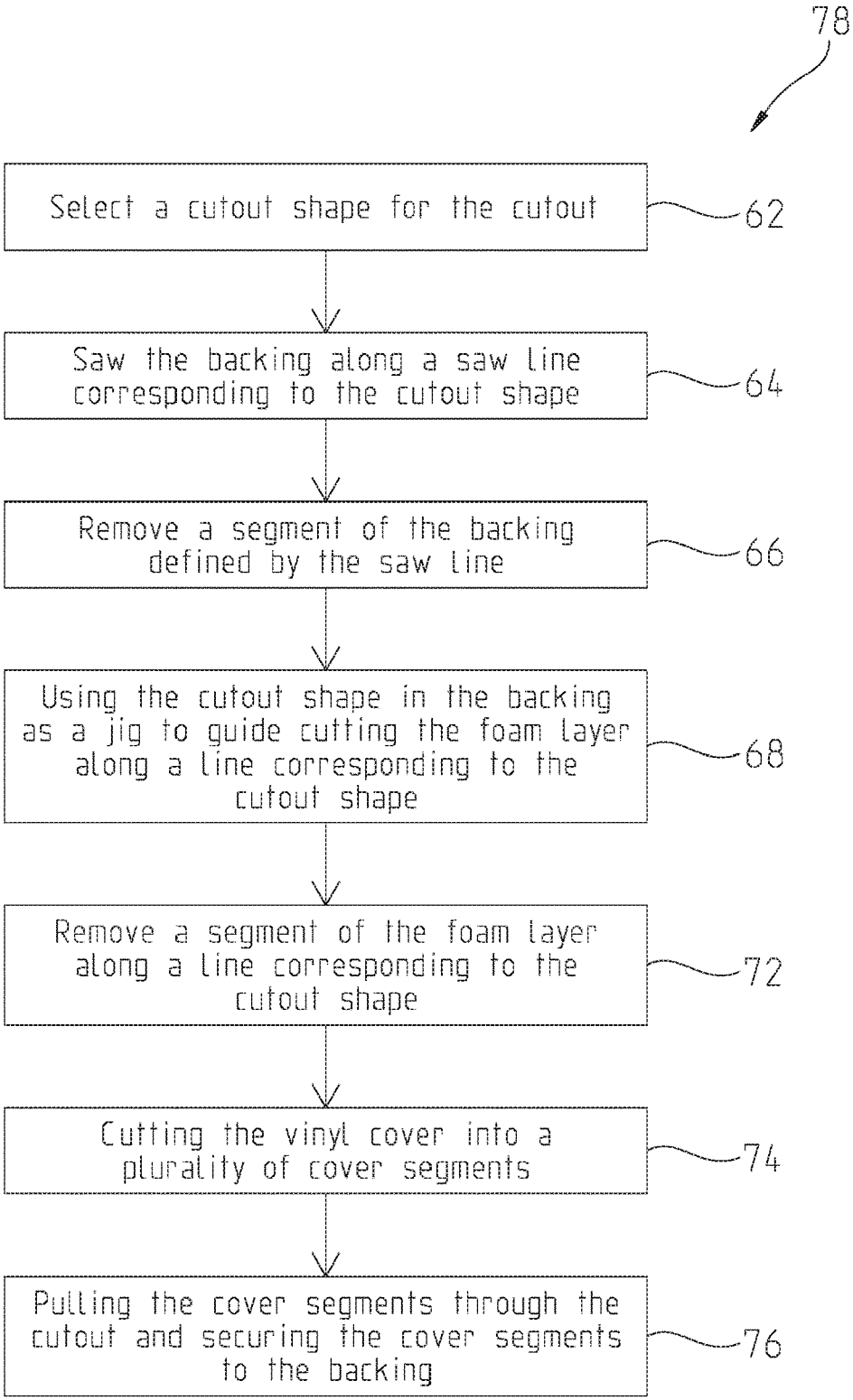
FIG. 11 illustrates an exemplary method for removing a portion of a protective wall panel to form a cutout in the protective wall panel.

To remove a portion of first wall panel 20 and second wall panel 22 to define cutout 24, the method illustrated in FIG. 11 may be implemented. In step 62 of method 78, the cutout shape for cutout 24 is selected. The shape for cutout 24 will generally correspond to the perimeter of the functional aspect to which access is desired. Method 78 then progresses to step 64 at which the backing layer is sawed along the line corresponding to the cutout shape selected in the preceding step. Step 64 may be implemented in a number of ways. For example, if first wall panel 20 and second wall panel 22 are joined prior to implementation of method 78, then a hole saw or drill may be utilized to initially form an aperture through backing 52 into which the blade of a saw, such as a jigsaw may be positioned. If first wall panel 20 and second wall panel 22 are separable, then step 64 may be implemented merely by applying a saw blade directly to backing 52 at an exterior surface of the corresponding panel 20, 22 intersecting the cutout shape selected in step 62. In an exemplification, backing 52 is cut in step 64 to a depth of backing 52, i.e., stopping short of cutting foam layer 54. After step 64 is complete, method 78 progresses to step 66 at which a segment of backing 52 defined by the saw line is removed. Method 78 then progresses to step 68 at which the cutout shape formed in backing 52 by steps 64 and 66 is utilized as a jig to guide cutting foam layer 54 along a line corresponding to the cutout shape. Specifically, an electric carving knife can be used to cut foam layer 54. In an exemplification, foam layer 54 is cut to a depth of foam layer 54, i.e., stopping short of cutting covering 56. Method 78 then progresses to step 72 at which a segment of foam layer 54 corresponding to the shape of cutout 24 is removed. To this point in the method, covering 56 is left undisturbed. Method 78 continues at step 74, with covering 56 cut into a plurality of covering segments. For example, covering 56 may be cut into segments 80 and 82, as illustrated in FIG. 1. Segments 82 are interior segments that will be discarded, while segments 80 will be pulled through the cutout and secured to backing 52, as illustrated in FIG. 5. This step of the method is illustrated at step 76 in FIG. 11. Step 76 of method 78 ensures that covering 56 remains taut over first wall panel 20 and second wall panel 22. Securing segments 80 to backing 52 may be done with staples 58 inserted through covering 56 and into cutout wall segments 28 as illustrated in FIG. 4, or by stapling covering 56 to the back of backing 52 with staple 58, as illustrated in FIG. 5.

Figure 3:
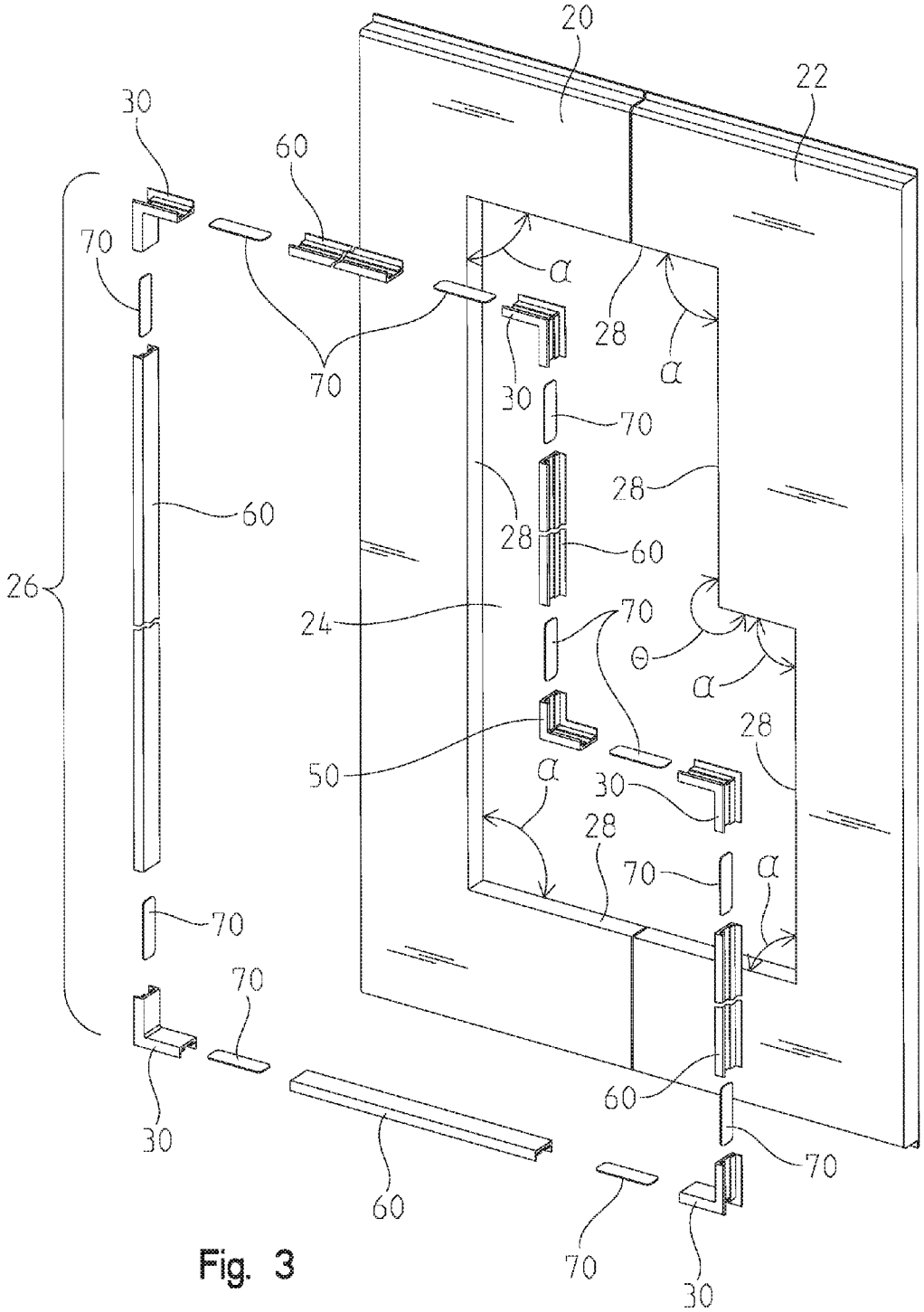
FIG. 3 is an exploded view of the arrangement illustrated in FIG. 2.
Figure 3A:
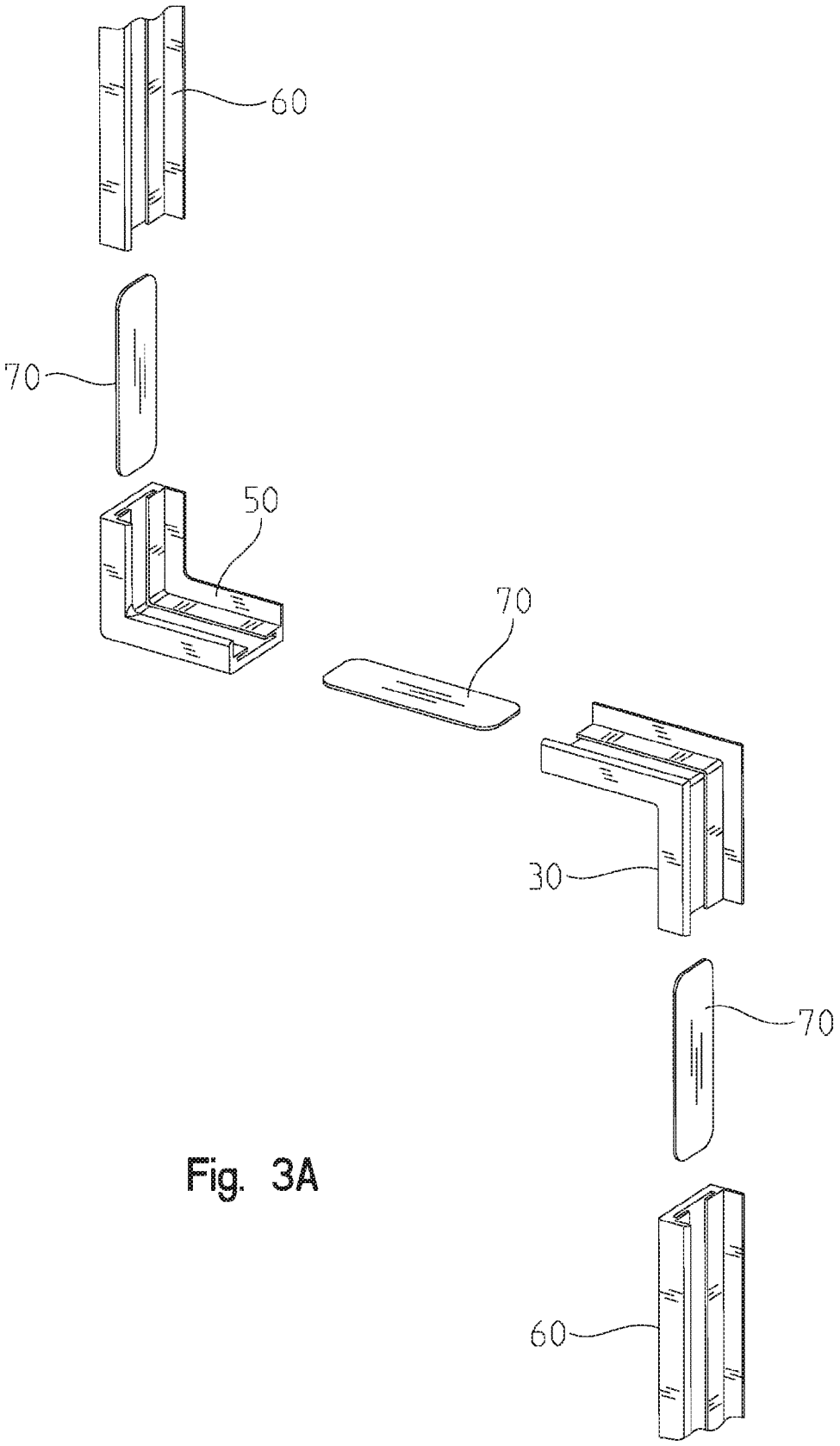
FIG. 3*a* is an enlarged, partial exploded view of the trim kit utilized in FIGS. 2 and 3.

With cutout 24 formed in first wall panel 20 and second wall panel 22, trim kit 26 (see e.g., FIGS. 2 and 3) can be assembled to trim cutout wall segments 28 defining cutout 24. In the exemplary embodiment, cutout 24 comprises a polygonal cutout formed by cutout wall segments 28 joined at cutout angles α and θ. To facilitate trimming such a polygonal cutout, trim kit 26 includes trim modules comprising interior corner modules 30 and exterior corner modules 50 as well as straight trim modules 60. Corner modules 30, 50 are formed at angles α and θ as described below.

Trim modules 30, 50 and 60 share similar features which allow them to be assembled as a continuous trim for cutout 24. In this patent specification, these similar features are denoted with similar reference numerals having alternate letters appended thereto. Specifically, the shared features are denoted with a reference numeral having the alphabetic designator "i," "e," and "s" appended thereto, depending on whether they are a part of interior corner module 30, exterior corner module 50 and straight module 60, respectively. When referencing one of these shared features generically, i.e., as a part of any of the trim modules, no letter is appended to the reference numeral.

Figure 6:
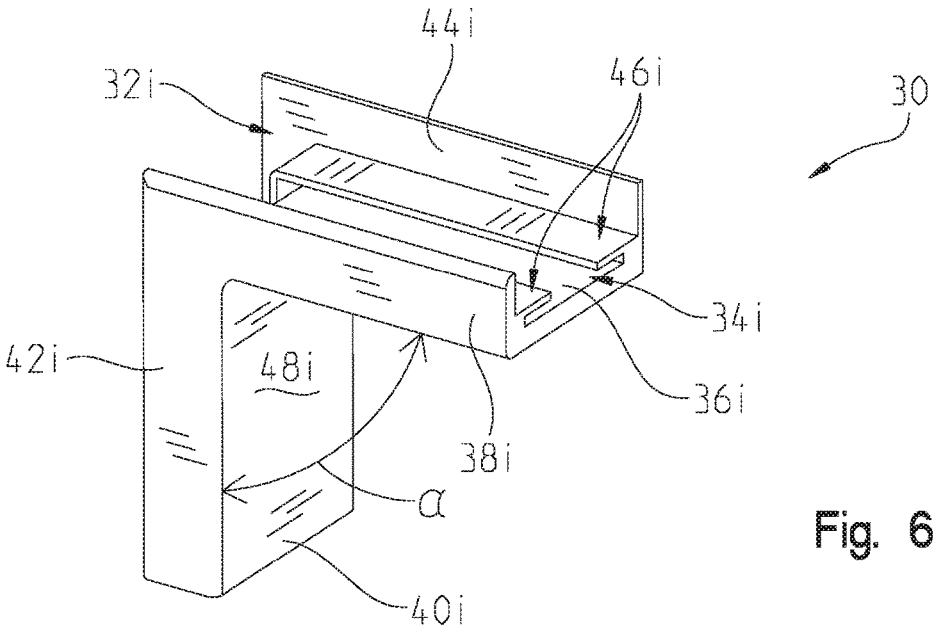
FIG. 6 is a first perspective view of an interior corner trim module.
Figure 8:
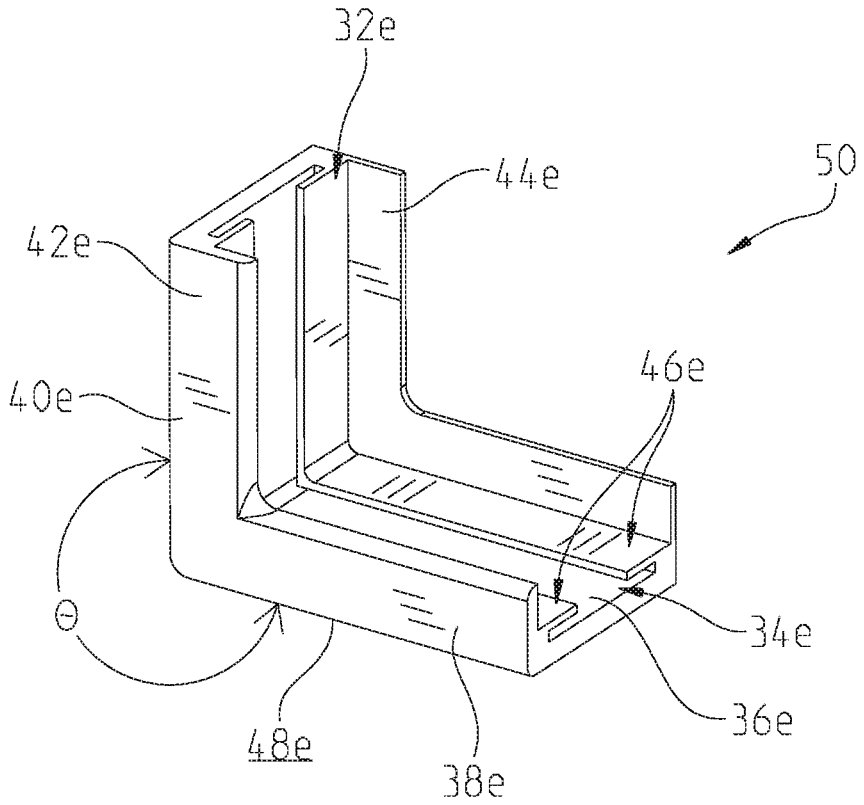
FIG. 8 is a perspective view of an exterior corner trim module.
Figure 10:
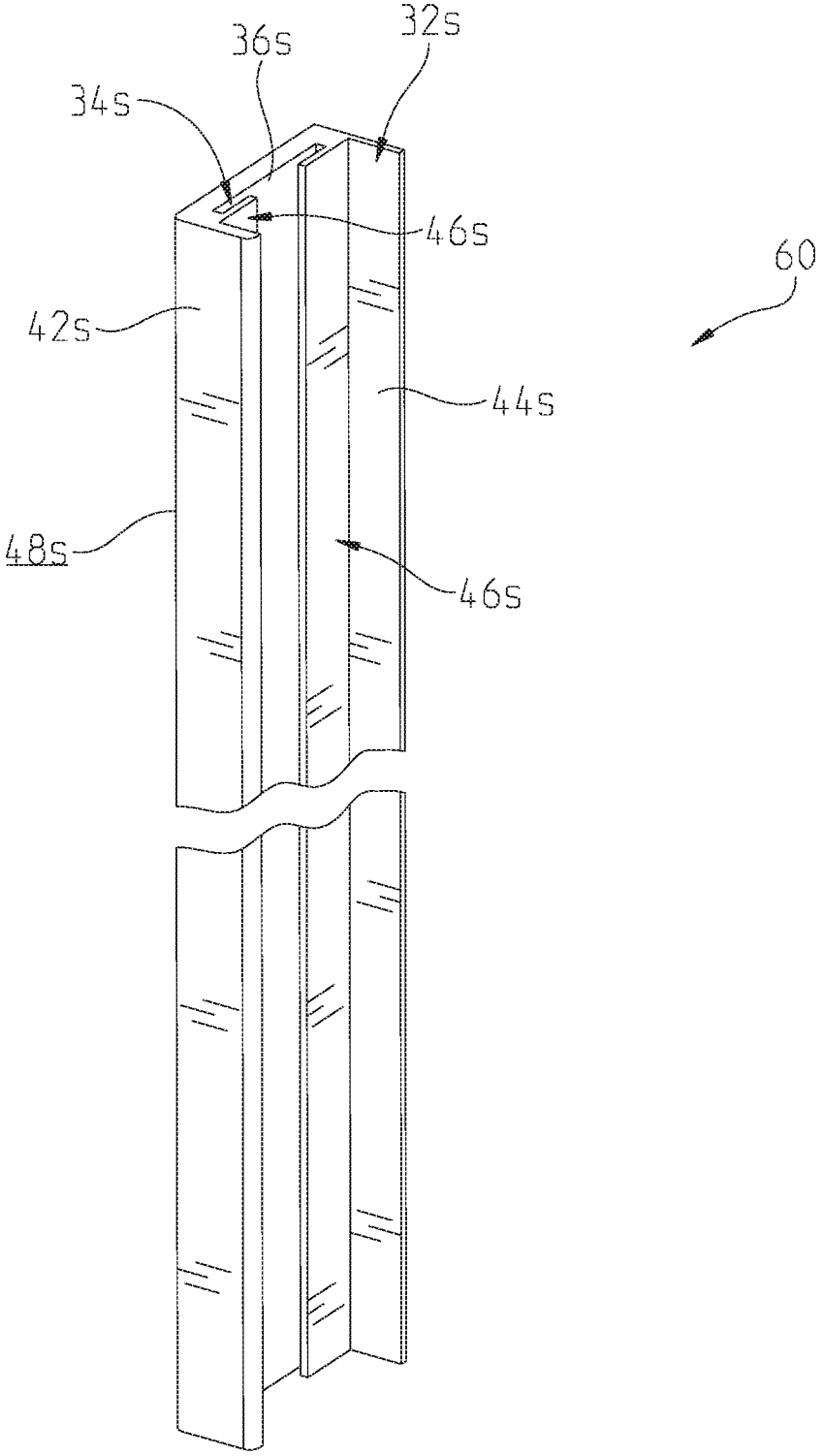
FIG. 10 is a perspective view of a straight trim module of the present disclosure.

Referring to FIG. 6, interior corner trim module 30 includes first leg 38*i* extending from second leg 40*i* with an angle α formed there between. Specifically, angle α is drawn between the finished surface 48*i* on each of first leg 38*i* and second leg 40*i* such that angle α does not intersect U-shaped channel 32*i* (described in detail herein below). Angle α is also defined between the longitudinal axis of first leg 38*i* and second leg 40*i*. In the exemplary embodiment, angle α is about 90 degrees, i.e. it is nominally 90 degrees. Interior corner module 30 may be formed with first leg 38*i* and second leg 40*i* separated by any angle less than 180 degrees. Referring to FIG. 8, exterior corner trim module 50 similarly includes first leg 38*e* extending from second leg 40*e* and forming an angle θ there between. Specifically, angle θ is drawn between the finished surface 48*e* on each of first leg 38*e* and second leg 40*e* such that angle θ does not intersect U-shaped channel 32*e*. Angle θ is also defined between the longitudinal axis of first leg 38*e* and second leg 40*e*. Exterior corner trim module 50 may be formed with first leg 38*e* and second leg 40*e* separated by any angle more than 180 degrees. Angles α and θ of interior corner trim module 30 and exterior corner trim module 50 correspond to angles α and θ formed by intersecting cutout wall segments 28 (FIG. 3) such that interior corner trim module 30 and exterior corner trim module 50 are effective at trimming the corners formed at the vertices of polygonal cutout 24. Referring to FIG. 10, straight trim module 60 does not include intersecting legs but rather is nominally formed with a linear longitudinal axis.

Figure 7:
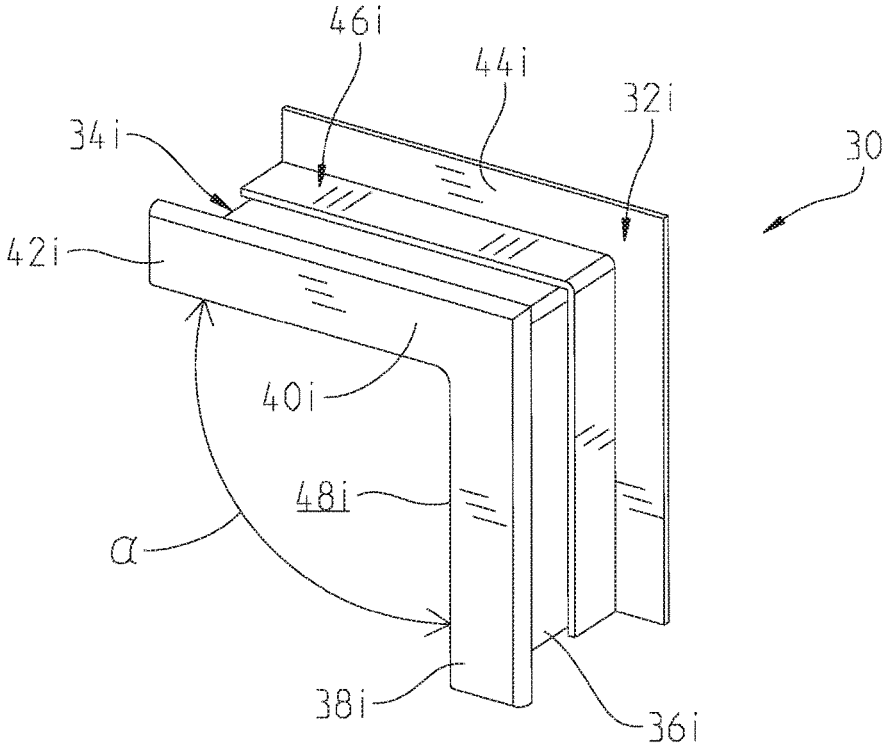
FIG. 7 is a second perspective view of the interior corner trim module of FIG. 6.

Referring to FIGS. 6 and 7, interior corner trim module 30 includes finished surface 48*i* extending along both first leg 38*i* and second leg 40*i*. Finished surface 48*i* is a generally smooth surface free of sharp corners. Generally, finished surface 48*i* is an esthetically pleasing surface free of geometries that would likely cause harm to an individual forced against finished surface 48*i*. Opposite finished surface 48*i* extends U-shaped channel 32*i*. U-shaped channel 32*i* has as a base perimeter surfaces 46*i*, with face flange 42*i* and securement flange 44*i* extending upwardly from base perimeter surface 46*i* to complete U-shaped channel 32*i*. Formed below base perimeter surface 46*i* is connector channel 34*i*, which is defined by connector channel wall 36*i* which defines a slot beneath each perimeter surface 46*i*. U-shaped channel 32*i* extends opposite finished surface 48*i* along both first leg 38*i* and second leg 40*i*. Similarly, connector channel 34*i* is continuously formed below perimeter surface 46*i* along both first leg 38*i* and second leg 40*i*. For the sake of brevity, the corresponding parts of exterior corner trim module 50 and straight trim module 60 are not described. Generally, interior corner trim module 30, exterior corner trim module 50, and straight trim module 60 only differ in the angle between their finished surfaces 48, i.e., less than 180 degrees (interior corner trim module 30), 180 degrees (straight trim module 60) and more than 180 degrees (exterior corner trim module 50).

Figure 9:
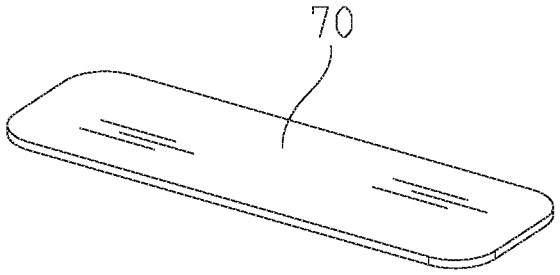
FIG. 9 is a perspective view of a connector utilized to connect a first trim module of the trim kit to a second trim module of the trim kit.

Trim kit 26 further includes a plurality of connectors 70 (FIG. 9). Connectors 70 are sized to provide a mild interference fit in connector channel wall 36 formed in each of the trim modules. Therefore, connector 70 can be positioned in connector channels 34 of two adjacent trim modules to secure the two trim modules one to the other to provide a continuous finish surface 48 and a continuous U-shaped channel 32 spanning the adjacent trim modules. Connectors 70 are obscured from view when connecting adjacent trim modules, as connector channels 34 are positioned opposite finished surface 48 (i.e., on the panel side of the trim modules). When trimming cutout 24, a pair of corner modules to be joined by a straight trim module 60 can first be positioned in their respective corners of cutout 24, with a connector 70 inserted in an interference fit in the connector channel 34 of each corner module and extending therefrom. In this position, a first end of a straight trim module 60 can be inserted over connector 70 such that connector 70 occupies connector channel 34*s* in straight trim module 60 and straight trim module 60 abuts the corner module from which connector 70 extends. Because straight trim module 60 is sized to span the two corner modules, the installer may bow straight trim module 60 slightly to allow for insertion of a connector 70 extending from a second corner trim module to be inserted into connector channel 34*s* at the opposite end of straight trim module 60 before straightening straight trim module 60 to provide a continuous finished surface between the two corner modules. This procedure will be utilized to complete trimming of cutout 24, with straight trim modules 60 being cut to size to span corner modules separated by a cutout wall segment 28 which does not include a corner. Straight trim modules 60 are sufficiently flexible to accommodate the installation method described above and are also sufficiently flexible to follow a contour of a cutout wall segment 28 between adjacent corners. As such, trim modules 60 may be used to trim linear sections of cutout 24, curved sections of cutout 24, spline sections of cutout 24, and other non-linear profiles of cutout 24. Furthermore, straight trim modules 60 may be joined by a connector 70 end-to-end to form a ring to trim a ring shaped cutout. The ring so formed need not fit into a circular cutout only, as the flexibility of straight trim module 60 will accommodate other arcuate shapes. The ring of this form of the present disclosure will provide a trim extending along the longitudinal axis of the trim module through 360 degrees and will flexibly conform to an arcuate and possibly undulating cutout wall segment.

As illustrated in FIG. 5, U-shaped channels 32 are sized to accommodate a thickness of a wall panel 22 positioned therein. With U-shaped channels 32 occupied by a wall panel 22, a staple or other connector may be inserted through securement flange 44 of a respective trim module to secure the trim module in place. Adhesive may also be applied to the interior surfaces of the trim module which will abut the wall panel to facilitate securement of the trim modules to the wall panel. If adhesive is used to secure the trim modules in place, then securement flange 44 may be rendered superfluous. Therefore, trim modules of alternative embodiments may incorporate an L-shaped channel formed by face flange 42 and perimeter surface 46, while eliminating securement flange 44.

At times, a pair of corner trim modules will be utilized with no straight trim module 60 positioned there between. In these circumstances, corner trim modules, e.g., 30, 50 can be cut to size to accommodate the geometry of cutout 24. An example of such a configuration is shown with exterior corner trim module 50 illustrated in FIGS. 2 and 3 immediately adjacent to an interior corner trim module 30 to the right. In this configuration, interior corner module 30 is first fit to second wall panel 22 with a connector 70 frictionally engaged in connector channel 34*i* and extending therefrom. In this position, exterior corner trim module 50 may be slid over connector 70 with connector 70 frictionally occupying connector channel 34*e*.

First wall panel 20 and second wall panel 22 are nominally formed as 2 foot by 6 foot rectangular pads, with backing 52 comprising a 7/16 inch thick waferboard and foam layer 54 comprising a 2 inch thick polyethylene foam and covering 56 comprising a 14 ounce per square yard solid vinyl coated polyester fabric with a breaking strength of 350 psi and a tear resistance of 65 pounds. Covering 56 is resistant to rot, mildew and ultraviolet light. Trim modules 30, 50 and 60 are, in an exemplary embodiment thereof, made of polyvinyl-chloride (PVC) with a durometer hardness SHORE A 75-80.

Although cutout 24 is shown as spanning first wall panel 20 and second wall panel 22, in one embodiment, cutout 24 is completely contained within a perimeter envelope of first wall panel 20. In another embodiment, cutout 24 extends into the first wall panel along a first portion of its perimeter and has as a second portion of its perimeter formed of a side of the second wall panel.

While this invention has been described as having exemplary designs, the present invention may be further modified with the spirit and scope of this disclosure. Further, this application is intended to cover such departures from the present disclosure as come within known or customary practice in the art to which this invention pertains.

What is claimed is:

1. A trim module system for trimming an opening in at least one panel, comprising:

a plurality of selectively interconnectable trim modules adapted to be positioned to trim the opening in the at least one panel, at least one of the plurality of interconnectable trim modules comprising:

a unitary corner trim module comprising:

a first leg, the first leg having a substantially linear first leg longitudinal axis running along a length of the first leg, the first leg having a first leg finished surface and a first leg reception channel, the first leg finished surface, adapted to face the opening, being positioned opposite the first leg reception channel, and including an uninterrupted face extending from adjacent a forwardmost extent of the first leg to adjacent a rearwardmost extent of the first leg; and a second leg extending from the first leg, the second leg having a substantially linear second leg longitudinal axis running along a length of the second leg, the second leg having a second leg finished surface and a second leg reception channel, the second leg finished surface, adapted to face the opening, being positioned opposite the second leg reception channel, and including an uninterrupted face extending from adjacent a forwardmost surface of the second leg to adjacent a rearwardmost surface of the second leg, the second leg reception channel intersecting the first leg reception channel of the first leg, the first leg longitudinal axis intersecting the second leg longitudinal axis to form an angle, whereby said corner trim module is adapted to be positioned over a corner of the at least one panel to trim the corner; and a plurality of connectors sized and shaped to connect a pair of the plurality of selectively interconnectable trim modules, each of the plurality of interconnectable trim modules having a connector channel wall defining a connector channel sized to frictionally receive a connector of said plurality of connectors, whereby, with one of said plurality of connectors frictionally received in the connector channel of each of the pair of the plurality of selectively interconnectable trim modules, each of the pair of trim modules is secured to the other of the plurality of trim modules.

2. The trim module system of claim 1, wherein said first leg reception channel comprises a first U-shaped channel and said second leg reception channel comprises a second U-shaped channel.

3. The trim module system of claim 1, wherein said corner trim module comprises an interior corner trim module, whereby an angle between the first leg finished surface and the second leg finished surface that does not intersect the first leg reception channel and the second leg reception channel measure less than 180 degrees.

4. The trim module system of claim 3, wherein said angle between the first leg finished surface and the second leg finished surface measures about 90 degrees.

5. The trim module system of claim 1, wherein said plurality of selectively interconnectable trim modules comprises a plurality of the corner trim modules.

6. A trim module system for trimming an opening in at least one panel, comprising:

a plurality of selectively interconnectable trim modules adapted to be positioned to trim the opening in the at least one panel, at least one of the plurality of interconnectable trim modules comprising:

a unitary corner trim module comprising:

a first leg, the first leg having a substantially linear first leg longitudinal axis running along a length of the first leg, the first leg having a first leg finished surface and a first leg reception channel, the first leg finished surface, adapted to face the opening, being positioned opposite the first leg reception channel, and including an uninterrupted face extending from adjacent a forwardmost extent of the first leg to adjacent a rearwardmost extent of the first leg; and a second leg extending from the first leg, the second leg having a substantially linear second leg longitudinal axis running along a length of the second leg, the second leg having a second leg finished surface and a second leg reception channel, the second leg finished surface, adapted to face the opening, being positioned opposite the second leg reception channel, and including an uninterrupted face extending from adjacent a forwardmost surface of the second leg to adjacent a rearwardmost surface of the second leg, the second leg reception channel intersecting the first leg reception channel of the first leg, the first leg longitudinal axis intersecting the second leg longitudinal axis to form an angle, whereby said corner trim module is adapted to be positioned over a corner of the at least one panel to trim the corner, wherein said corner trim module comprises an exterior corner trim module, whereby an angle between the first leg finished surface and the second leg finished surface that does not intersect the first leg reception channel and the second leg reception channel measure more than 180 degrees.

7. The trim module system of claim 6, wherein said angle between the first leg finished surface and the second leg finished surface measures about 270 degrees.

8. A trim module system for trimming an opening in at least one panel, comprising:

a plurality of selectively interconnectable trim modules adapted to be positioned to trim the opening in the at least one panel, at least one of the plurality of interconnectable trim modules comprising:

a corner trim module comprising:

a first leg, the first leg having a substantially linear first leg longitudinal axis running along a length of the first leg, the first leg having a first leg finished surface, a first leg reception channel, and a first leg connector channel, the first leg finished surface positioned opposite the first leg reception channel and the first leg reception channel being wider than the first leg connector channel; and a second leg extending from the first leg, the second leg having a substantially linear second leg longitudinal axis running along a length of the second leg, the second leg having a second leg finished surface, a second leg reception channel and a second leg connector channel, the second leg finished surface positioned opposite the second leg reception channel and the second leg reception channel being wider than the second leg connector channel, the first leg longitudinal axis intersecting the second leg longitudinal axis to form an angle, whereby said corner trim module is adapted to be positioned over a corner of the at least one panel to trim the corner, wherein said first leg reception channel comprises a first U-shaped channel having a first side wall and a second side wall and said second leg reception channel comprises a second U-shaped channel having a third side wall and a fourth side wall, the third side wall of the second leg reception channel is continuous with the first side wall of the first leg reception channel and the fourth side wall of the second leg reception channel is continuous with the second side wall of the first leg reception channel.

9. The trim module system of claim 8, further comprising a plurality of connectors sized and shaped to connect a pair of the plurality of selectively interconnectable trim modules, each of the plurality of interconnectable trim modules having a connector channel wall defining the first leg connector channel, where the first leg connector channel is sized to frictionally receive a connector of said plurality of connectors, whereby, with one of said plurality of connectors frictionally received in the first leg connector channel of each of the pair of the plurality of selectively interconnectable trim modules, each of the pair of trim modules is secured to the other of the plurality of trim modules, a portion of the first leg connector channel of the corner trim module being positioned between the first leg finished surface and the first leg reception channel.

10. The trim module system of claim 9, wherein both of the first leg reception channel and the portion of the first leg connector channel of the corner trim module are accessible from a first end of the first leg opposite the second leg.

* * * * *